US006473914B1

(12) United States Patent
Houlle et al.

(10) Patent No.: US 6,473,914 B1
(45) Date of Patent: Nov. 5, 2002

(54) FLEXIBLE SUBMERSIBLE PANEL FOR POOL FORMED WITH ELONGATED HOLLOW ELEMENTS AND CORRESPONDING USE

(76) Inventors: Béatrice Houlle, 10 rue des Artisans, Mittelhausen F-67170 (FR); Edwin Wojta, 10 rue des Artisans, Mittelhausen F-67170 (FR)

( * ) Notice: Subject to any disclaimer, the term of this patent is extended or adjusted under 35 U.S.C. 154(b) by 0 days.

(21) Appl. No.: 09/831,730

(22) PCT Filed: Nov. 10, 1999

(86) PCT No.: PCT/FR99/02772

§ 371 (c)(1),
(2), (4) Date: Aug. 16, 2001

(87) PCT Pub. No.: WO00/29697

PCT Pub. Date: May 25, 2000

(30) Foreign Application Priority Data

Nov. 13, 1998 (FR) ..... 98 14374

(51) Int. Cl.[7] ..... E04H 4/00

(52) U.S. Cl. ..... 4/501
(58) Field of Search ..... 4/495, 501, 499

(56) References Cited

U.S. PATENT DOCUMENTS 4,716,603 A * 1/1988 Sernetz ..... 4/501

* cited by examiner

*Primary Examiner*—Charles E. Phillips
(74) *Attorney, Agent, or Firm*—Young Law Firm, P.C.

(57) ABSTRACT

Submersible panel (2) for pools, particularly swimming pools (1), consisting of hollow, elongated, modular parts (2*a*, 2*b*, 2*c*, 2*d*, 2*e*, 2*f*, 2*g*, 2*h*) assembled together. The parts comprise a water inlet at one end and a water outlet at the other. The openings of the panel are connected either directly or indirectly to means for distributing compressed gas.

The edges of said panel (1) more or less match the walls of the pool to constitute a pool cover in the upper position and at least one bottom in the submerged position.

The upper and lower horizontal surfaces of the panel are plane and free, the measurements of said upper horizontal surface being more or less equal to the length of the pool which is suitable for constituting the cover in the upper position and at least two bottom levels of the pool in the submerged position.

Use of the panel (1) to constitute the bottom of the pool.

15 Claims, 3 Drawing Sheets

FIG.4
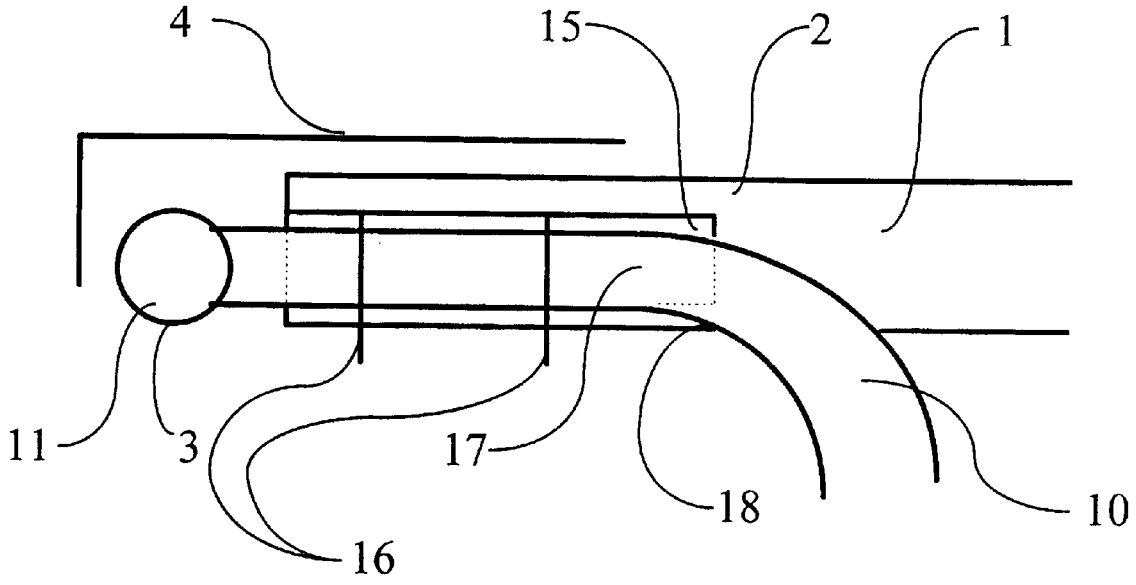
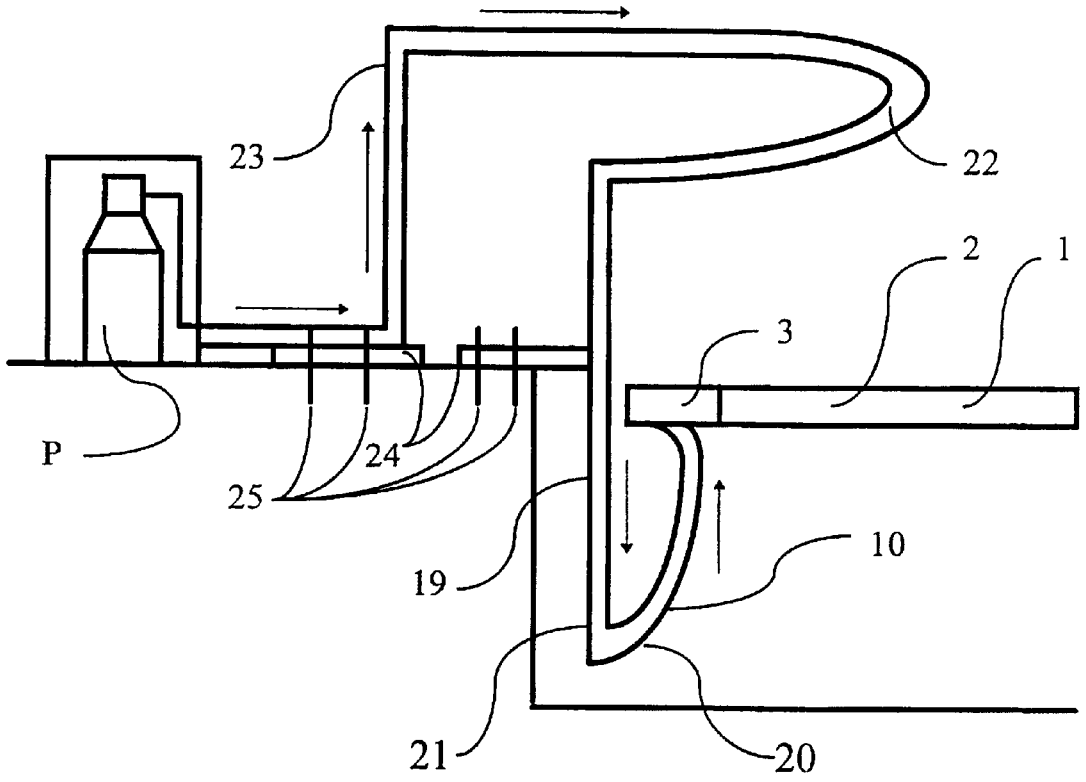
FIG.5

FLEXIBLE SUBMERSIBLE PANEL FOR POOL FORMED WITH ELONGATED HOLLOW ELEMENTS AND CORRESPONDING USE

Flexible submersible pool panel consisting of hollow, elongated, modular parts and the use thereof.

The present invention relates to a flexible submersible pool panel, particularly for swimming pools, consisting of modular hollow, elongated parts assembled together.

More precisely, it relates to a panel consisting of parts comprising a water inlet at one end and a water outlet at the other, said openings located on the forward sides facing the panel being connected either directly or indirectly by a distributor tube.

Swimming pool covers that float between two bodies of water and that consist of hollow parts connected with specially shaped connectors to fulfill this function have already been described in German patent DE 33 24 406 (G. Stifter).

According to the above-mentioned patent the hollow parts comprise a cover, a base and continuous uprights to define the hollows. Furthermore, the cover is connected to a reversible pump that is in fact an hydraulic pump.

Consequently, the function of these hollow parts is to provide water currents internally in one direction and then the other. This is illustrated by the special shape of the connectors consisting of flexible pipes that constitute not only the hydraulic but also the mechanical joint with small serrated sleeves made of an elastic material.

Consequently, the panels are torn off if excessive force is applied.

It is therefore necessary to use small hollow parts. In order for the cover to be large enough to cover a pool said cover always includes several of these small hollow parts connected end-to-end via said elastic connectors. Consequently, the cover includes a multitude of joints between said parts.

The movements of each hollow part result from the internal, random water currents. The density of the hollow parts is therefore approximately the same as or greater than that of the pool water and the movements are opposite to one another. This leads to a risk of tearing occurring at the joints, or at least relative movement between the hollow parts. The use of elastic connectors is required in addition to the small hollow parts.

In as far as the covers are concerned this leads to difficulties in ensuring the safety of the pool. The small hollow parts, the density of which is approximately that of water, are unable to bear a child's weight, particularly in or around the joints. These parts are therefore only used as a cover and do not protect against drowning.

The second problem with known covers is that they are difficult to clean. In the event of the covers being fastened elastically end-to-end each joint defines a groove on the surface of the cover. Incomplete cleaning of the grooves enables bacteria to proliferate. Furthermore, repetitive complicated cleaning movements lead to wear on the cover.

Also, for all movements, whether ascending or descending, as the hollow parts are supplied with water the entire distributor tube is located under the cover in order to connect said cover to a pump fitted in a specific housing at the bottom of the pool, with all the building difficulties this implies.

The aim of the invention is to provide a panel capable in itself of withstanding a child's weight to ensure safety, that is fitted easily without requiring any work at the bottom of the pool to embed a turbine and enable effective cleaning of the surface by means of compressed gas being distributed, particularly air from a pump such as a tube, a section of which passes above the hollow, elongated, modular parts of the panel of the invention and above the surface of the pool and another section of which passes under the surface of the pool. In particular, the means for distributing gas comprise an aerial distributing tube section that may be connected directly to a submerged tube section for introducing compressed gas that may be connected directly to the hollow, elongated, modular part. This joint, which may be direct, is disposed underneath or on top of the sides of the modular part. The edges of said panel more or less match the walls of the pool to constitute a pool cover in the upper position and at least one bottom in the submerged position.

Panels constituting covers of this type are described, for example, in European patent application No. 0 044 104. These known submersible panels consist of several hollow, modular parts fastened together. According to one version the hollow part of each section defines a floodable, leaktight cavity. The cavity fills with water from the pool increasing the weight of each part and causing the panels to sink. The cavities of the various parts are connected to a source of compressed air that enables the water to be drained from the cavities under the pressure of the air. The drainage of the water lightens the parts and causes the panels to rise to the surface. The panels that float to the surface constitute a cover for the pool when the water is drained away from said cavities.

The panels have the advantage of stirring the water when they are submerged which homogenizes the water, provides a constant temperature and removes the bacteria that usually accumulate in the corners and at the edges. In the out-of-the-water position, i.e. when it constitutes a cover, the panel insulates the pool water from the outside air thus maintaining the pool temperature and economizing energy.

However, these known panels have drawbacks, particularly in as far as cleaning is concerned, as they are fastened to the fixed bottom of the pool by cables and various mechanisms, the lower surface of the panel possibly being provided with hinged feet to enable the panel to stop in an intermediate position on said unfolded feet. All these mechanisms impede the passage of cleaning robots and require access under the panel for them to be put into operation. They also complicate panel assembly by requiring special fittings.

In order to avoid special fitting work and to eliminate bacteria while enabling effective cleaning of the pool to be performed without wear, the upper and lower horizontal surfaces of said panel according to the invention are flat and free. The measurements of said upper horizontal surface are more or less equal to the length of the pool and said surface is suitable for constituting the cover in the upper position and at least two bottom levels of the pool in the submerged position.

In order for the panel in the lower submerged position to cover the bottom of the pool and avoid a smooth external coating being applied, such as tiling for swimming pools, including pools with several levels, for example for swimming pools with large and small pools separated by a sloped plane, the parts of the panel are connected end-to-end by at least one hinged, mechanical joint that is double-mounted with at least one flexible pipe that constitutes a leaktight connection between the hollow section of said parts.

This avoids the panel, in its position of covering the fixed bottom of the pool, having a bulge at the edge indicating the change of the pool bottom level, a bulge which would create a siphon effect in the pool water.

To this end, as the pool is sufficiently large to have several bottom levels, the measurements of a single horizontal panel are more or less equal to the length of the pool and can constitute the pool bottom in a lower position, each individual part or one that is assembled end-to-end has at least one other part that constitutes the length of said panel.

According to another characteristic the panel joint comprises a horizontal axle that is locked and fastened in two flanges that extend the end of a part such that it is fixed, said axle being held such that it is free to rotate and prevented from performing a translation movement in the aperture of another flange that extends the next part such that it is fixed and such that, when in the lower position, the panel assumes the shape of the pool bottom on either side of the edge marking the change in level.

The air entering the cavities must be sufficiently compressed to force out the water. The air has a tendency to be distributed along one side of the panel if said panel is wide. This raises the side in which the air is directed while the other side remains full of water. If the pool is three meters deep the panel tips and the lower section is subjected to considerable pressure of three bar, the air-filled section is raised and the panel breaks as it rises to the surface.

In order to avoid the panel from tipping and breaking, it consists transversally of at least one fixed assembly of several hollow, modular parts in which the forward side of the panel comprises a manifold to supply each of the parts of an end of the panel with gas from at least one nozzle connected by a central pipe to the tube that introduces compressed gas, the horizontal piping of the manifold comprising a water inlet and/or outlet opening at each end and comprising at least one valve capable of adjusting the flow-rate of fluid of each of the end openings.

Maintaining the panel in a horizontal position enables it to stop at an intermediate level to create a shallow pool, despite the absence of feet under the free lower surface.

To enable the panel to rise and remain horizontal under the pressure balance between the air and water present in the cavities, the manifold, which is capable of supplying each part of an end of the panel with gas, is itself supplied with at least two sources of compressed gas such that it creates two fluid circuits, a valve being disposed on the central pipe between the two fluid circuits such that it homogenizes the pressure between the two circuits.

In order to simplify manufacture and provide the panel with a plane surface up to the wall of the swimming pool the central pipe and pipe supply nozzles of the manifold are disposed horizontally in the axis of the hollow, modular parts and are protected with a cover such that the panel is constituted by the modular parts and the manifold.

In order to facilitate maintenance and enable the use of the entire surface of the panel a bracket-shaped cover that protects the manifold and maintains a downwards opening is fastened to the surface of the parts by at least one screw.

The invention also relates to a vertical guiding device for any of the submersible, flexible panels described above. The device is characterized in that, working from the bottom of said pool, it extends above the surface of the pool and constitutes at least one concave ridge, in particular constituted by rigid tubes, above said pool. The vertical section of the device has an external surface that constitutes a free, smooth guiding surface to enable the panel to rise. The device is fastened to the ground near the pool.

This device, with its free guiding surface and stop, guides the panel when it rises without said panel damaging the walls and edge of the pool by falling back once it has emerged.

According to other characteristics:

- the rigid sections of the device constitute at least two stops that are more or less aligned at the same level above said pool,
- the panel constituting a submersible pool cover is characterized in that the tube for introducing compressed gas has a rigid section that constitutes the guiding and stop section of a device in compliance with that described above,
- the panel comprises rigid, vertical guiding means with a stop comprising a rigid, vertical submersible section positioned symmetrically to the section including the tube for introducing compressed gas along the same forward wall of the pool.

The invention also relates to a method for guiding the rising of a panel that constitutes a submersible cover such as those described above, characterized in that the cover rises in the pool full of liquid when it is filled with compressed gas that evacuates the liquid contained in the hollow, tubular parts and is guided freely by sliding on an external surface of at least one rigid vertical part that extends from the surface to the bottom of the pool, said cover emerging out of the liquid and being stopped by a stop disposed on the vertical part above the surface of the pool and then falling back onto the surface to cover the liquid.

The invention also relates to the use of a panel, in compliance with those described above, for regulating the pressure in said submersible panel by means of valves such that said panel stops to constitute the bottom of the pool at the required depth.

A non-limitative example of an embodiment of the invention is described below and refers to the attached figures where:

FIG. 4 is a cross-section of a manifold fastened horizontally in the axis of the modular parts;

FIG. 5 is a cross-section through a vertical guiding device for a panel of the invention.

Figure 1:
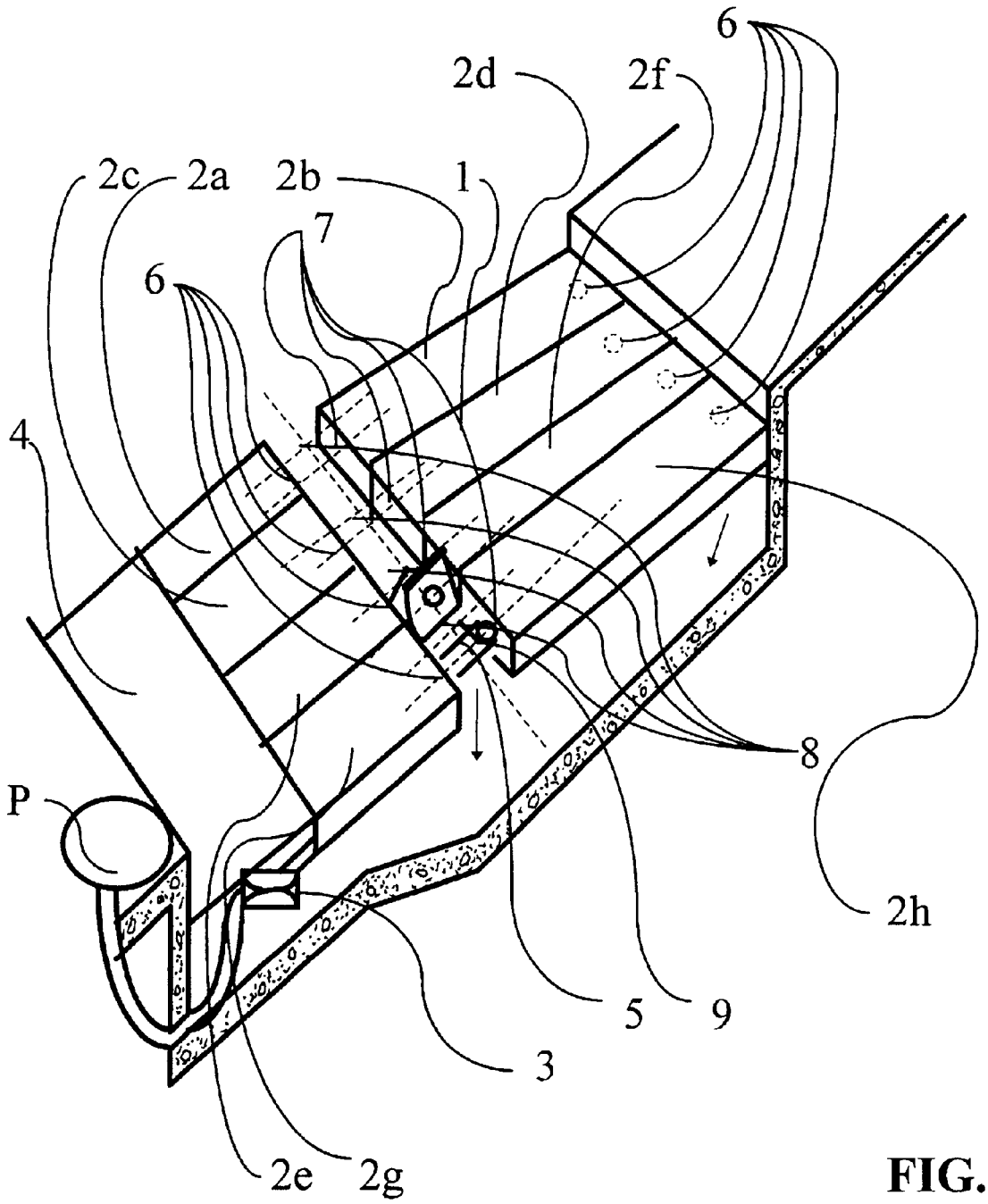
FIG. 1 is a schematic side view of a pool equipped with the panel of the invention.
Figure 2:
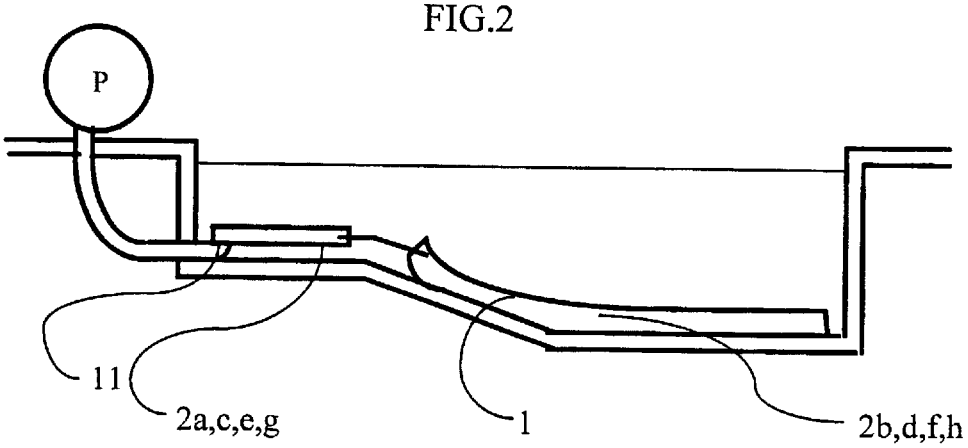
FIG. 2 is a cross-section of the pool of FIG. 1 in which the panel is in the lower submerged position.

The pool of FIG. 1 is covered with a panel 1 consisting of various hollow sections 2*a*, 2*b*, 2*c*, 2*d*, 2*e*, 2*f*, 2*g*, 2*h* and a manifold 3 covered with a cap 4. Laterally, the hollow sections, which are braced lengthwise, are clipped together using the tongue and groove principle of assembling until the length of the pool is obtained. The ends are sealed by end-caps that are clipped together and bonded 2*i*. Longitudinally, the sections are connected together with a hinged joint 5. These hollow sections are leaktight and comprise water inlets 6 on the forward end. Air inlets 7 are disposed on the rear end. Hinged joint 5 connects these parts end-to-end with at least one mechanical hinge 8 that is double-mounted with a flexible pipe 9 connecting the hollow section of said parts such that it is leaktight from water inlets 6 of the various hollow sections 2*a*, 2*c*, 2*e*, 2*g* to air inlets 7 of the various hollow sections 2*b*, 2*d*, 2*f*, 2*h*. The rear section of the pool comprises a small bath and the forward section a large pool. The two pools are separated by a sloped plane the upper limit of which constitutes an edge where the small bath begins. Panel 1 is submersible and can descend from the surface to the fixed bottom of the pool, as shown in FIG. 2. The various hollow sections 2*a*, 2*c*, 2*e*, 2*g* cover the bottom of the small bath and constitute a covering, the hinged joint enabling the upper section of the hollow sections 2*b,* 2*d,* 2*f,* 2*h* to form a slope. The angle of incline of these parts gradually reduces, detaching them from the sloped plane and they come to lie on the bottom of the large bath up to the front of the swimming pool. A large surface of panel 1 lies on the bottom of the large bath, while at the other end the panel lies over the entire bottom of the small bath.

Figure 3:
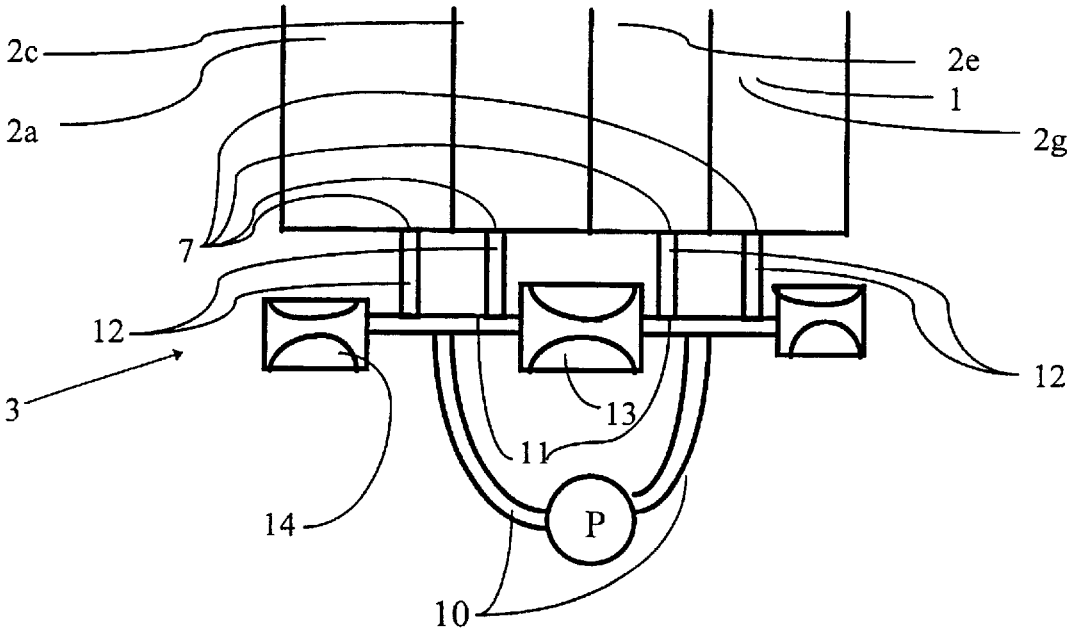
FIG. 3 is a top view of a manifold provided with pressure balancing valves connected to the hollow parts of the invention.

As shown in FIG. 3 manifold 3 is supplied with compressed air via two flexible tubes 10 that come from a source of compressed air P. These tubes 10 open into a central pipe 11 of manifold 3. Flexible tubes 12 connect central pipe 11 to air inlets 7 of the various hollow sections 2*a,* 2*c,* 2*e,* 2*g*. As manifold 3 is supplied with compressed air from the two flexible tubes 10, panel 1 comprises two fluid circuits. A valve 13 is mounted in the middle of central pipe 11 to connect the two fluid circuits together. Each end of central pipe 12 is fitted with an opening that opens into the pool. This opening is controlled by valves 14. When panel 1 rises under the effect of the compressed air inlet valves 13, 14 are sufficiently large to maintain the pressure balance over the entire width of the panel in proportion to the pressure resulting from the depth. Panel 1 can rise regularly and even stop at an intermediate horizontal position.

FIG. 4 is a cross-section of the rear part of panel 1 showing the end of a hollow section part 2 to which manifold 3 is connected. Said manifold 3 is flat, the axes of its various tubes and pipes lying in the same plane. Sleeve 15 constitutes mechanical fastening means to maintain the plane of the axes of manifold 3 in the same plane as the axes of hollow sections 2. Sleeve 15 is held in the end of hollow sections 2 by screws 16. Each rigid end 17 of flexible air inlet tubes 10 is housed in sleeve 15 and passes through an opening 18 in hollow section part 2. The far end of tube 10 is connected to central pipe 11 of manifold 3. Cover 4 is more or less parallel to the plane of the axes of the pipes and tubes of manifold 3 and hollow sections 2. Cover 4 is fastened to hollow sections 2 and covers manifold 3. The end of the cover 3 is bent downward in a bracket shape. Panel 1 therefore has a free plane upper surface parallel to the plane containing the axes of manifold 3 and hollow sections 2. The bracket shape of cover 4 enables it to cover the visible top and rear surface of manifold 3.

FIG. 4 is a cross-section of the free guiding device 19 of panel 1 consisting of hollow sections 2 extended by sleeve 3. Compressor P is connected to panel 1 by pipe 10.

Pipe 10 has a flexible section 20 that reaches from panel 1 to the bottom of the pool and is extended by a straight, vertical, rigid section 21.

Vertical section 21 rises above the pool and is extended by a section 22, which is also rigid and overhangs the rear end of the pool and panel 1 forming a concave ridge. Section 22 of pipe 10 is extended by a section 23 connected to compressor P. Pipe 10 is fastened by feet 24 that are screwed to the floor with screws 25.

It is unnecessary to go into the pool to install free guiding device 19. Flexible section 20 of pipe 10 enables panel 1 to remain connected to compressor P even when it has descended to the bottom of the pool. Rigid section 21 of pipe 10 prevents impacts between panel 1 and the rear wall of the pool. Concave ridge 22 and the upper section of rigid section 21 prevent panel 1 from rising too high and falling back onto the ground at the edge of the pool.

In one version it is possible to install another vertical guiding bar, at the same time as the rigid section of the pipe, that also has a concave ridge above the pool and that prevents panel 1 from pivoting around rigid section 21 of pipe 10, particularly when only one of said pipes is installed for small pools.

Panel 1 of the invention operates as follows: when valves 13, 14 close they create a balance between the atmospheric pressure and the water pressure of the pool. Consequently, the water cannot enter hollow sections 2*a,* 2*b,* 2*c,* 2*d,* 2*e,* 2*f,* 2*g,* 10, 2*h* and panel 1 floats to the surface of the pool. In this position, panel 1 constitutes a cover that insulates the pool water from the outside air this economizing energy and providing safety from drowning as the cover can bear the weight of several people.

Panel 1 is submerged when valves 15 open. Opening the valves causes the air contained in the sections to be released and water to flow in through the end openings of central pipe 12 of manifold 3. Panel 1 is held in the lateral horizontal position by adjusting valve 13. Hollow sections 2*a,* 2*b,* 2*c,* 2*d,* 2*e,* 2*f,* 2*g,* 2*h* are gradually filled with water. One end of panel 1 begins to submerge. In order to create a shallow pool, for example for baby swimmers, it is possible to stop panel 1 at this intermediate level constituting the bottom at the level selected by closing valves 14. Valve 13 maintains the balance of the panel. To obtain a deep pool with large and small baths, valves 13 are left open and hollow sections 2*a,* 2*b,* 2*c,* 2*d,* 2*e,* 2*f,* 2*g,* 2*h* continue to be filled with water. Panel 1 finally lies on the fixed bottom of the pool. The hinge enables joint 5 to cover the edge of the bottom of the pool and panel 1 to cover the fixed bottom of the small bath without creating a bulge that would cause a siphon effect. After joint 5 panel 1 descends in a decreasing slope towards the fixed bottom of the large bath.

Compressed air is blown by turbines P in hollow sections 2*a,* 2*b,* 2*c,* 2*d,* 2*e,* 2*f,* 2*g,* 2*h* to raise panel 1 to the surface. The air forces the water out and the panel begins to rise. Valves 13 act as gates and it is therefore possible to stop panel 1 in an intermediate position in which it constitutes the bottom of a shallow pool. It is also possible to raise panel 1 until it rises out of the water. It floats on the surface and constitutes a cover over the pool.

The thermal insulation of panel 1 is excellent due to the air contained in hollow sections 2*a,* 2*b,* 2*c,* 2*d,* 2*e,* 2*f,* 2*g,* 2*h*.

The leaktightness of panel 1 totally prevents evaporation and significantly reduces heat losses due to temperature variations, wind and water/air exchanges.

Energy and temperature savings are considerable in open-air swimming pools when panel 1 is totally submerged due to the absorption qualities of the pool, particularly when the panel is dark in color.

In large pools, for example a fifty-meter swimming pool, joint 5 enables hollow sections 2*a,* 2*b,* 2*c,* 2*d,* 2*e,* 2*f,* 2*g,* 2*h,* which are less than twenty-five meters long, to be transported and assembled at the edge of the pool, which simplifies handling operations.

Even though the invention has been described in relation with specific structures it is non-limitative and may exist in a number of version, for example in combination of embodiments shown in the figures or described above or include several joints, particularly for pools of complicated shapes with several convex or concave edges, and still remain within the scope of the invention.

The sole aim of the reference numbers given after the technical characteristics in the claims is to provide a clearer understanding of said claims and in no way limits their scope.

What is claimed is:

1. A submersible panel for a swimming pool filled with water, comprising:

a panel assembly including a plurality of hollow and elongated panel parts assembled together, the panel assembly defining an upper and lower surface, both the upper and lower surfaces being plane and free, the panel assembly being configure to be at least partially filled with water from the pool and to be at least partially evacuated by compressed gas to form a pool cover covering a surface of the water in the pool when at least partially filled with the compressed gas and at least one submerged pool bottom at a selectable depth in the pool when at least partially filled with pool water, the plurality of assembled panels parts defining a first fluid circuit and a second fluid circuit;

a manifold coupled to the panel assembly, the manifold being configured to selectively admit at least compressed gas into the panel assembly, the manifold including a first valve that is configured to couple the first fluid circuit to the second fluid circuit and to homogenize a pressure between the first and second fluid circuits;

a compressed gas supply means coupled to the manifold, the compressed gas supply means being effective to selectively supply the compressed gas to the panel assembly through the manifold and to at least partially evacuate water contained in the assembled plurality of panel parts to cause the panel assembly to be selectively and at least partially filled with compressed gas or pool water.

2. The panel of claim 1, wherein at least some of the panel parts are connected together end-to-end by at least one hinged mechanical joint, the at least one hinged mechanical joint being doubled-mounted with at least one flexible pipe that forms a leaktight connection between the connected panel parts.

3. The panel of claim 2, wherein the joint includes a horizontal axle that is configured to enable rotation and to prevent translation of the connected panel parts.

4. The panel of claim 1, further including a second valve and a third valve, the second valve coupling the first fluid circuit to the water of the pool and the third valve coupling the second fluid circuit to the water of the pool.

5. The panel of claim 1, wherein the manifold includes a plurality of valves configured to homogenize a pressure between the first and second fluid circuits, to selectively admit compressed gas into the first and second fluid circuits and to selectively admit water from the pool in the first and second fluid circuits.

6. The panel of claim 5, further including a central pipe interconnecting the plurality of valves and wherein the central pipe and the plurality of valves are axially aligned with the plurality of assembled panel parts.

7. The panel of claim 1, further comprising a manifold cover configured to cover the manifold.

8. The panel of claim 7, wherein the manifold cover is bracket shaped and defines a downward-facing opening that is configured to be fastened to a surface of the panel assembly by at least one screw.

9. The panel of claim 1, wherein the manifold is effective to adjust pressure within the plurality of assembled panel parts so as to enable at least a portion of the panel to remain submerged in water at a selected depth in the pool or float on a surface of the water in the pool.

10. The panel of claim 9, wherein the selected depth ranges from just under the surface of the water to the bottom of the pool.

11. The panel of claim 1, further comprising a vertical part that extends from a surface of the water of the pool to the bottom of the pool, the panel assembly being further configured to freely slide against the vertical part.

12. Method of raising and lowering a panel assembly within a swimming pool filled with water, comprising:

providing a panel assembly that includes plurality of hollow and elongated parts that define a fist fluid circuit and a second fluid circuit, the panel assembly being configured to enable compressed gas and the pool water to be admitted therein;

providing means for selectively supplying compressed gas to and evacuating compressed gas from the panel assembly;

providing means for selectively admitting pool water into the panel assembly and evacuating pool water from the panel assembly, and supplying compressed gas to the panel assembly to selectively raise the panel assembly within the swimming pool and causing a corresponding evacuation of pool water from the panel assembly;

admitting pool water into the panel assembly to selectively lower the panel assembly within the swimming pool and causing a corresponding evacuation of compressed gas from the panel assembly, and homogenizing a pressure in the first fluid circuit and a pressure in the second fluid circuit.

13. The method of claim 12, further comprising selectively varying an amount of compressed gas and water supplied to and admitted into the panel assembly to selectively raise or lower the panel within the swimming pool to a selected depth, the selected depth ranging from a surface of the water in the pool to a bottom of the pool.

14. The method of claim 12, further comprising sliding against a rigid vertical part that extends form a surface of the water in the pool to a bottom of the pool during the selective raising and lowering steps.

15. The method of claim 14, further comprising providing a stop on the vertical part and wherein the selective raising step is effective to raise the panel assembly until the panel reaches the stop, wherein upon reaching the stop, the panel assembly falls back onto the surface of the water of the pool.

* * * * *

UNITED STATES PATENT AND TRADEMARK OFFICE

CERTIFICATE OF CORRECTION

PATENT NO. : 6,473,914 B1
DATED : November 5, 2002
INVENTOR(S) : Houlle

It is certified that error appears in the above-identified patent and that said Letters Patent is hereby corrected as shown below:

Column 7,
Line 3, “configure” should be -- configured --

Column 8,
Line 17, “fist” should be -- first --
Line 27, delete “, and” and insert -- ; --
Line 47, “form” should be -- from --

Signed and Sealed this

Sixth Day of May, 2003

JAMES E. ROGAN
*Director of the United States Patent and Trademark Office*